United States Patent [19]

Jones

[11] Patent Number: 4,787,544

[45] Date of Patent: Nov. 29, 1988

[54] DANCER ROLLER

[76] Inventor: Charles R. Jones, Rte. 2, Box 99, Tippah County, Miss. 38683

[21] Appl. No.: 859,398

[22] Filed: May 5, 1986

[51] Int. Cl.[4] ..... B65H 20/24

[52] U.S. Cl. ..... 226/118; 226/97; 226/190; 226/195

[58] Field of Search ..... 226/44, 97, 118, 119, 226/190, 194, 195; 242/75.3, 75.43, 75.5, 75.51, 189, 190

[56] References Cited

U.S. PATENT DOCUMENTS

| | | | |
|---|---|---|---|
| 2,765,165 | 10/1956 | Johnson | 242/75.3 X |
| 2,974,894 | 3/1961 | Aaron | 242/75.43 |
| 2,998,175 | 8/1961 | Topping | 226/119 X |
| 3,249,315 | 5/1966 | Peltier | 242/75.3 |
| 3,297,221 | 1/1967 | Licht et al. | 226/195 X |
| 3,567,093 | 3/1971 | Johnson | 226/97 |
| 3,727,820 | 4/1973 | Braun | 226/118 X |
| 3,790,056 | 2/1974 | Schmidt et al. | 226/195 |
| 4,265,386 | 5/1981 | Levy et al. | 226/190 |
| 4,316,587 | 2/1982 | Gauthier | 242/75.43 X |

FOREIGN PATENT DOCUMENTS

| | | | |
|---|---|---|---|
| 78262 | 10/1954 | Denmark | 226/119 |

OTHER PUBLICATIONS

IBM Technical Disclosure Bulletin, "Tension Controller", J. R. Middleton, vol. 15, No. 4, 9/1972.

*Primary Examiner*—Daniel P. Stodola
*Attorney, Agent, or Firm*—C. A. Phillips

[57] ABSTRACT

A dancer roller apparatus for controlling tension in a sheet material as the sheet material is wound between a pair of rollers. The apparatus includes a housing having a cavity, an entrance, and an exit opening communicating into the cavity for passage of the sheet material into and out of the cavity. The cavity is provided therein with a pair of end arcuate surfaces and a guide channel which is disposed adjacent the end arcuate surfaces. An elongated movable roller is positioned in the cavity atop the sheet material for applying a tension to the sheet material between the entrance and exit openings. The roller includes end arcuate surfaces for closely fitting in the end arcuate surfaces of the housing. A first gear segment is secured to the arcuate ends of the roller, and a gear rack is movably carried in each of the guide channels for meshed relation with the first gear segment.

9 Claims, 4 Drawing Sheets

DANCER ROLLER

FIELD OF THE INVENTION

This invention relates generally to apparatus for unwinding, feeding, and conveying sheeted or webbed products; more particularly, the invention relates to a dancer roller for use in such apparatus for providing a desired tension to the products during the operation of the apparatus.

BACKGROUND OF THE INVENTION

Two electric motors built to be "identical" will have slightly different electrical characteristics; two gear boxes of the same design will have slightly different efficiencies. Other factors, which as temperature gradients and friction coefficient differencies, play a part. Accordingly, a sheet propelled by two consecutive drive rollers will either be drawn taut until slippage or breakage occurs, or else will sag between said rollers until it fouls on some part of the machinery. Therefore a surge device, usually in the form of a "dancer roller", commonly called a "dancer", is interposed, its purpose being to accumulate a short length of sheet, or to pay it out, either as required.

The dancer roller is usually provided in a two- or three-roller construction. In the three-roller configuration, a dancer roller is interposed between a pair of spaced rollers having the material drawn therebetween. In this configuration, the weight of the lower (movable) roller and its appurtenances is carried by a bight or loop of the goods being processed, and any needed further tension must be secured by weights, springs, or fluid cylinders applied to the ends of said lower roller. With the two-roller design, all tension must be so secured. With the three-roller design, the lower roller travels up and down ("dances"), and is guided in a short path. With the two-roller construction, either or both rollers travel horizontally along short closed-end tracks, or else are joined by bars across the roller ends, and travel in an arcuate path about a common central pivot. With both types of dancer rollers, commercially available sensors are located at each travel limit. These sensors signal the appropriate motor to change speed slightly, and start the movable roller back toward its mid range of travel. Both dancer roller configurations readily compensate for the gradual accrual changes in included length of sheet between propulsion points, but both are much too massive to respond to certain high frequency, low amplitude fluctuations that have come into play with the development of high-strength sheet products such as flexible packaging, which is gaining an ever-increasing market.

Examined from the viewpoint of statics, any roller in the dancer assembly may be considered to be a cylindrical beam loaded uniformly along a central portion of its length, but not to the ends. It thus must have walls thick enough to stand the loads imposed on it, and accordingly is quite heavily constructed, and cannot respond to rapid oscillations.

The second type of sheet/tension variation began to become troublesome when mills were being speeded up to meet demand for the high-strength sheet products mentioned above. In the manufacture of primary flat sheet, exact uniformity of thickness is not attainable. For various reasons relatively thicker and thinner areas will occur, which stack up on themselves when wound into a roll, causing "lobes" which, though not obvious, are readily located by measuring. During unwinding, the sheet is paid off at both longer and shorter radial distances from its geometrical center, alternating as much as several times per second. Other factors, such as goods roll dynamic unbalance, off-center chucking, machinery vibration, and sheet harmonics may compound the problems.

It should be noted here that the faster sheet is run through the processing line, the more tensed it must be, in order to expel the air which otherwise would remain trapped between the sheets and the conveying rollers and act as a lubricant, preventing desired sheet travel rate and tracking. Most processes require a taut sheet; trimming and slitting, for examples, cannot be done accurately on slack sheet. The modern approach is to run the sheet at a tension not far below the breaking point. For reasons given above, sheet breakage presently is a continuing and expensive problem.

Efforts to reduce the machine mass involved in present dancer roller design have not been very successful, because, with the manner in which the rollers are loaded, little can be done about their wall thicknesses and consequent massive weight.

Clearly two very different types of tension/included length difficulties in sheet processing need to be dealt with. The first is the gradual accrual type, which can become become sudden with laps or wrinkles in the unwind roll, or rapid speed changes as might happen with inexperienced operators. The second is the high-frequency, low-amplitude type usually accompanying higher processing speeds. The concepts set forth in this Application address both types, and propose to reduce them to acceptable proportions.

DETAILED DESCRIPTION OF DRAWINGS

Figure 1:
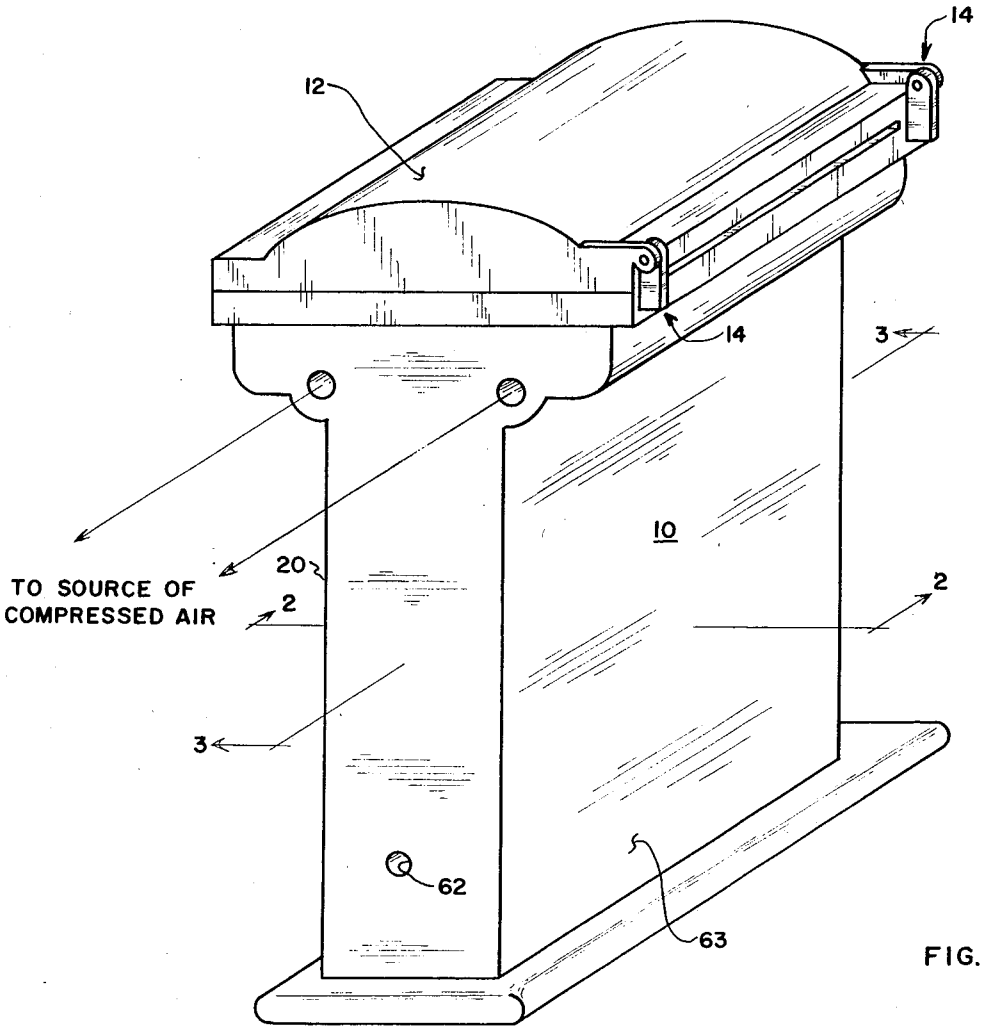
FIG. 1 is a pictorial view of the housing of the dancer roller assembly of the present invention.
Figure 2:
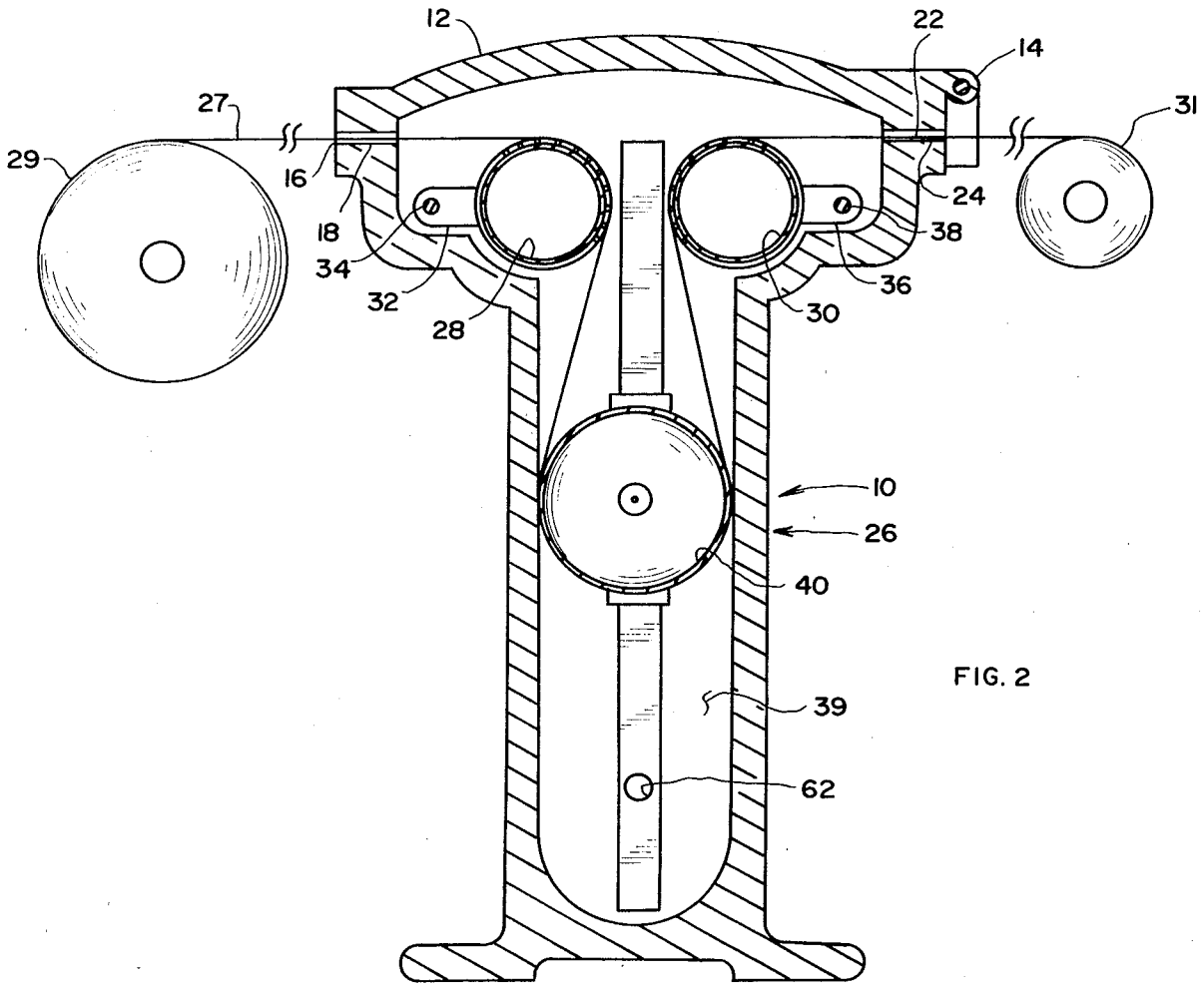
FIG. 2 is a sectional view taken along line 2—2 of FIG. 1.

As seen in FIGS. 1 and 2, a dancer roller assembly is shown to include a body or housing 10 having a top closure 12 pivoted on hinge assemblies 14 to swing up and allow access into the interior of the housing. An inlet slit 16 (FIG. 2) is provided beteen closure 12 and an upper surface 18 of a side 20 of housing 10. An exit slit 22 is provided between closure member 12 and upper surface 24 of a side 26 of housing 10. A pair of pivoted perforated telescoping tube assemblies 28 and 30 (FIG. 2) are each respectively connected to a source of air and positioned adjacent sides 20 and 26 of housing 10. A tab 32 extends from tube assembly 28 and is pinned to frame 10 by a pin 34. Tube 30 is similarly pivotally mounted through a tab 36 and a pin 38. When top closure 12 is pivoted upwardly, assemblies 28 and 30 can be swung upwardly to provide access into the interior 39 of the lower portion of the housing to insert or remove a dancer roller 40 in the housing. The roller may be handled by any suitable means, such as a hoist, etc. (not shown). The tube assemblies are adjustable to close off unneeded perforations when narrower sheets of material are run.

Figure 3:
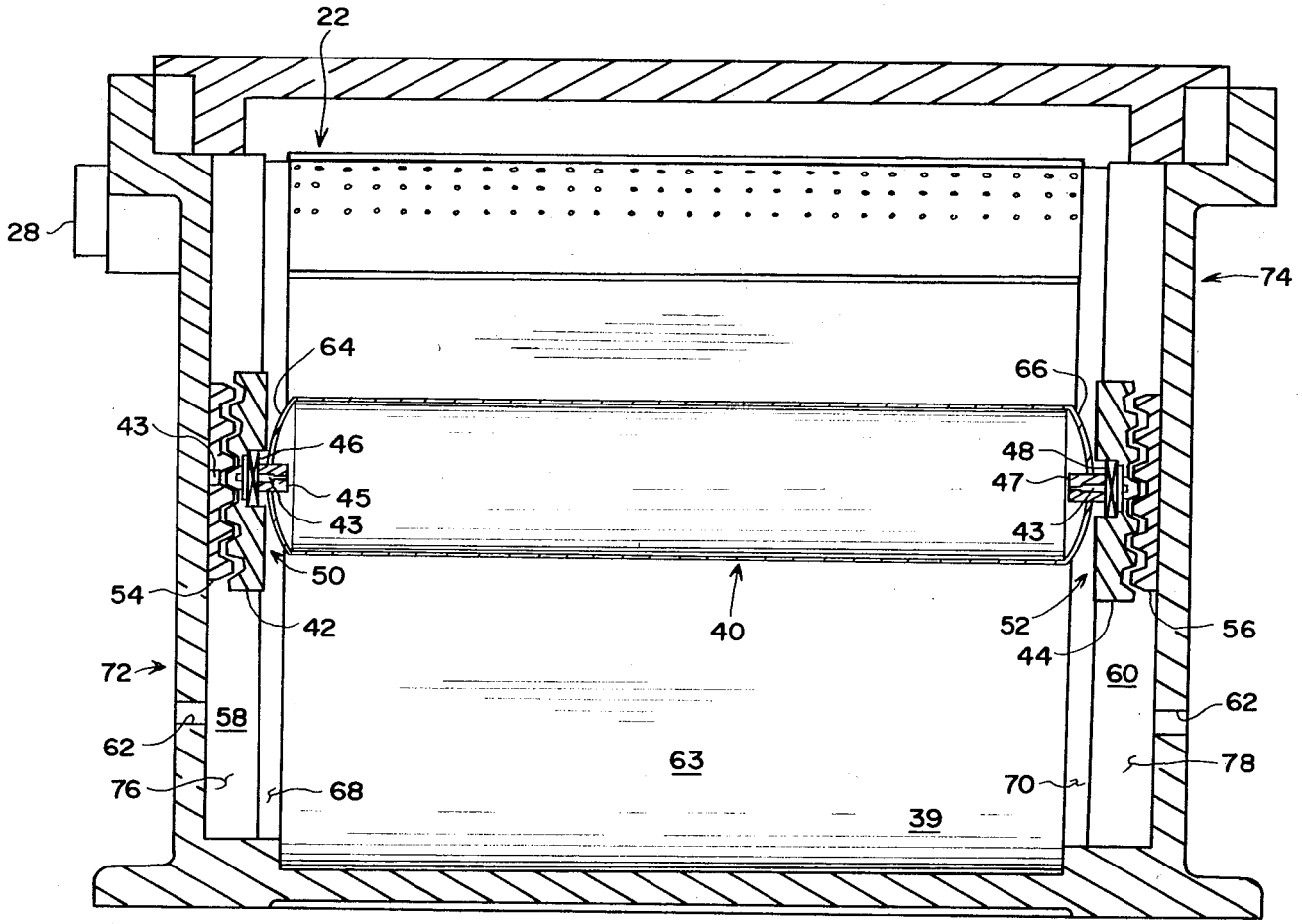
FIG. 3 is a sectional view taken along line 3—3 of FIG. 1.

As seen in FIG. 3, a pair of gear segments 42 and 44 are secured to the ends 50 and 52 of roller 40. Gear segments 42 and 44 also house bearings 46 and 48. The gear segments are disposed for meshing with slidable racks 54 and 56 slidably mounted in channels 58 and 60, respectively, on opposite sides 20 and 22 of the frame. Vent holes 62 are provided in the lower portion 63 of frame 10.

Figure 5:
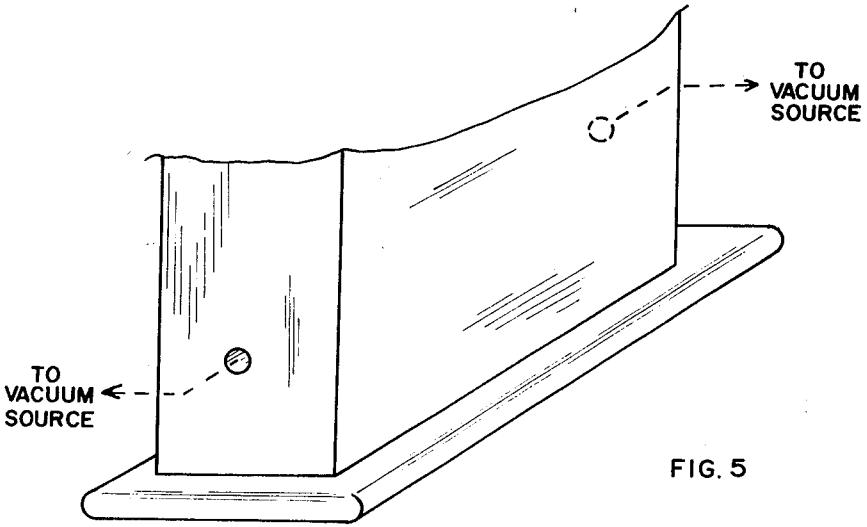
FIG. 5 is a partial view similar to FIG. 1 illustrating the lower opening in the housing being disposed for connection to compressed air.

Movable roller 40 (shown in section in FIG. 3), has integral end plates 64 and 66, outwardly dished as parts of a sphere whose outside diameter is twice radius R1 as shown. Gear segments 42 and 44 (shown in section), if extended, would form a gear whose pitch diameter is twice radius R2 as shown, and which is concentric with the spherical ends 64 and 66 on roller 40. Thus, when roller 40 tilts in response to laterally curved or "long-sided" goods, gear segments 42 and 44 (FIG. 5) articulates with racks 54 and 56, the distance back-to-back of racks 54 and 56 remaining constant. Gear segments 42 and 44 are machined to form also a housing for bearings 46 and 48, which is mounted on stub shafts 45 and 47, made integral with with roller end discs 64 and 66.

Figure 4:
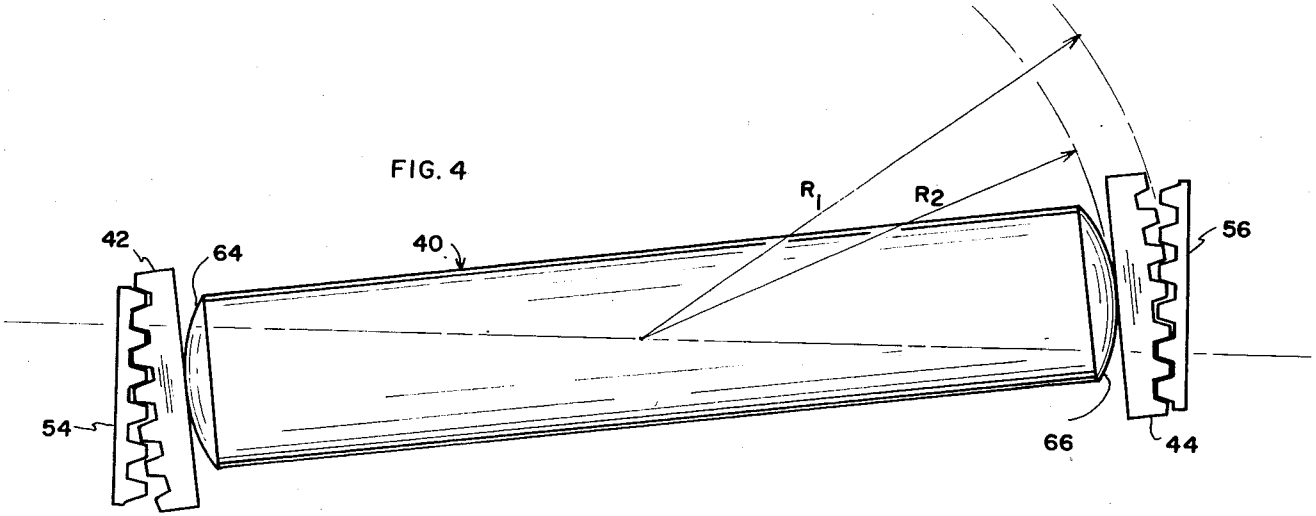
FIG. 4 is a diagrammatic view of the dancer roller in a tilted position.

A pair of curved surfaces 68 and 70 (FIGS. 3 and 4) is provided on the interior surfaces of opposite ends 72 and 74 inside the main body 10 which conforms to the contour of roller ends 64 and 66 as said roller 40 travels vertically. A pair of channels or ways 76 and 78 are disposed in frame 10 adjacent surfaces 68 and 70, respectively, in communication with the interior 39. The gear segment 42 and rack 54 fit closely and travel in channel 76, and gear segment 44 and rack 56 fit closely and travel in channel 78. Note here that, if released suddenly as when sheet 27 tears across, roller 40 and appurtenances will descend with considerable speed and force, which in conventional designs has been known to damage the dancer roller structure. The subject Invention proposes to contain and dissipate said force by locating vent holes 62 (through housing 10 wall), below the design travel range of racks 54 and 56, which, when over-travel occurs, valve off holes 62, thereby trapping a volume of air which cushions and stops the movable sub-assembly before damaging impact can occur.

As seen in FIG. 1, an air valve 43 is provided in the stub shafts 45 and 47 of roller 40. Inflation helps hold true roundness of the roller and also resists indentation during use. In operation, a single thickness of the goods 27 is pulled off the supply roll 29, usually by the first processing machine following the dancer roller. The sheet 27 may contact one or more rollers not shown before it reaches the dancer roller. It enters through entry slit 16, then curves downward about perforated pipe 28 which receives air from the compressed air source and directs the air through the perforations of the pipes. The air forms a layer of compressed air escaping through the perforations and holds the goods 27 out of contact with pipe 28, while being very rapidly displaceable sufficiently to absorb high-frequency but low amplitude changes in included length so as to prevent sheet breakage under the usual conditions. The sheet 27 then moves to and underneath movable roller 40 and upward to perforated pipe **14*b*, forming a bight which supports roller 40 and the gear segment assemblies and gear racks. Compressed air in the cavity above roller 40 adds any desired extra tension to sheet 27. The movable roller sub-assembly moves vertically in its range to pay out or to take up as necessary to maintain the desired tension in sheet 27. Because of the lighter construction made possible by the apparatus of the present invention, roller 40 can respond to sudden, larger changes in included length than conventional designs. At perforated pipe 30 the same conditions exist as at pipe 28, in the same manner absorbing rapid sheet oscillations "downstream" from the dancer roller. The sheet 27 leaves the dancer roller unit through exit slit 22, and continues through the series of processing machines (not shown) to be rewound as finished roll 31**.

If desired, a vacuum may be drawn through vent holes 62 (FIG. 5) of housing 10. It should be obvious that pressure differentials may exist on opposite sides of sheet 27. In one embodiment, these pressure differentials exist because of the force of gravity and weight of the roller assembly acting on the top of sheet 27. In a second embodiment, a vacuum is created in the housing beneath sheet 27.

It is to be understood that the form of the Invention herewith shown and described is to be taken as a preferred embodiment. Various changes may be made in size, shape, and arrangement of parts, for example: Equivalent elements may be substituted for those illustrated and described herein, parts may be reversed, and certain features may be utilized independently of the use of other features, all without departing from the spirit or scope of the Invention as defined in the subjoining claims. Machines constructed with this Invention may be re-oriented as to the horizontal or the vertical, or be built on separate frames, with many other departures readily perceivable to those familiar with the art.

Some advantages of the present invention are as follows:

1. Breakage of the sheet is greatly reduced because a layer of compressed air over which the sheet travels serves as an air bearing surface which absorbs high-frequency, low amplitude changes in the sheet travel.

2. Higher processing speeds are possible because the sheet may be run at tensions nearer the breaking point.

3. Faster speedup or slowing to stop incident to chucking supply rolls or removing finished rolls, because of reduced flywheel effect resulting from the use of nonrotating perforated pipes.

4. More even tension edge to edge of sheet, because movable roller tilts automatically to accommodate long-sided sheet. Hand-operated skew roller elsewhere in the line is eliminated.

5. Greater operator safety, because dancer roller mechanism is enclosed.

6. Greater machine safety, because movable roller is automatically protected against bottom impact if sheet is broken.

7. Reduced purchase cost of movable roller, because of lighter construction.

I claim:

1. A dancer roller apparatus for controlling tension in a sheet material as the sheet material is wound between a pair of rollers comprising:

a housing having a cavity and an entrance and an exit opening communicating into said cavity for passage of said sheet material into and out of said cavity, said cavity having therein a pair of end arcuate surfaces and a guide channel disposed adjacent said end arcuate surfaces;

an elongated movable roller positioned in said cavity atop said sheet material for applying a tension to said sheet material between said entrance and exit openings, said roller having end arcuate surfaces for closely fitting in said end arcuate surfaces of said housing;

an annular gear segment secured to each of said arcuate ends of said roller, the pitch of each said annular gear segment having a common radius measured from the axial center point of said roller; and a gear rack movably carried in each of said guide channels for meshed relation with a said annular gear segment.

2. Apparatus as in claim 1 including a telescoping tube assembly adapted for connection to a source of compressed air and positioned adjacent opposite sides of said housing adjacent said entrance and exit openings for supporting said sheet material thereon, said telescoping tube assemblies including an outer perforated cylinder and an inner telescoping sleeve disposed for directing said compressed air between said tube assemblies and said sheet material, whereby said directed air serves as an air bearing surface between said sheet material and said perforated cylinders.

3. Apparatus as in claim 2 wherein said housing is substantially air-tight to maintain a variable air pressure differential on opposite sides of said roller.

4. Apparatus as in claim 3 including a pair of openings disposed in said housing through the opposite ends thereof, said openings being positioned beneath the travel range of said movable roller.

5. Apparatus as in claim 4 wherein said housing includes a cover disposed in pivotal relation therewith, whereby said cover is pivotable relative to said housing to an open position to allow said roller to be positioned in or removed from said cavity.

6. Apparatus as in claim 5 wherein said telescoping tube assemblies are pivotally mounted in said cavity.

7. Apparatus as in claim 6 including an air valve assembly secured to said ends of said cylinder to permit air to be directed in or out of said cylinder.

8. Apparatus as in claim 4 wherein said openings communicate with said cavity and the atmosphere whereby in response to said movable roller, said gear segments and said racks descending in a rapid manner as a result of breakage of said sheet material, said racks will block said openings to trap a volume of air beneath said roller to cushion said roller against damaging impact with the bottom of said cavity.

9. Apparatus as in claim 4 wherein a vacuum may be drawn through said openings for evacuation of said housing.

* * * * *